United States Patent [19]

Rothwell, Jr. et al.

[11] 4,320,322

[45] Mar. 16, 1982

[54] ELECTRODE GEOMETRY TO IMPROVE ARC STABILITY

[75] Inventors: Harold L. Rothwell, Jr., Rowley; William M. Keeffe, Rockport; W. Calvin Gungle, Danvers, all of Mass.

[73] Assignee: GTE Products Corporation, Stamford, Conn.

[21] Appl. No.: 132,930

[22] Filed: Mar. 24, 1980

[51] Int. Cl.[3] ..... H01J 61/04; H01J 61/30

[52] U.S. Cl. ..... 313/217; 313/220; 313/349

[58] Field of Search ..... 313/217, 218, 216, 346 R, 313/349, 184, 185, 350, 220

[56] References Cited

U.S. PATENT DOCUMENTS 1,279,415 9/1918 Orange ..... 313/185 X

*Primary Examiner*—Marvin L. Nussbaum

*Attorney, Agent, or Firm*—William H. McNeill

[57] ABSTRACT

A high intensity discharge device operable in any orientation employs electrodes whose major portions are parallel and whose minor portions converge toward each other. The converging minor portions can be loops of electrode material.

3 Claims, 4 Drawing Figures

ELECTRODE GEOMETRY TO IMPROVE ARC STABILITY

TECHNICAL FIELD

This invention relates to high intensity arc discharge devices and more particularly to such devices having electrode configurations permitting operation in various physical orientations.

BACKGROUND ART

High intensity arc discharge devices, particularly those of the short arc variety, are designed for operation in a particular physical orientation, usually with the arc column either vertically or horizontally disposed. Failure to operate the device in its design mode usually leads to poor lamp maintenance and shortened life. This facet of these devices presents a burden upon ultimate users thereof to design equipment for a particular device orientation. It would be an advance in the art to provide a high intensity arc discharge device which could be employed in any physical orientation.

DISCLOSURE OF INVENTION

It is, therefore, an object of the invention to obviate the disadvantages of the prior art.

It is another object of the invention to enhance high intensity discharge devices.

These objects are accomplished, in one aspect of the invention, by the provision of a high intensity discharge device having an extremely stable arc. The stable arc is provided, in a single ended device, by electrodes which have major portions and minor portions. The major portions are substantially parallel with respect to each other and the minor portions are at least partially convergent towards each other. This configuration provides an extremely stable arc region between the convergent portions.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
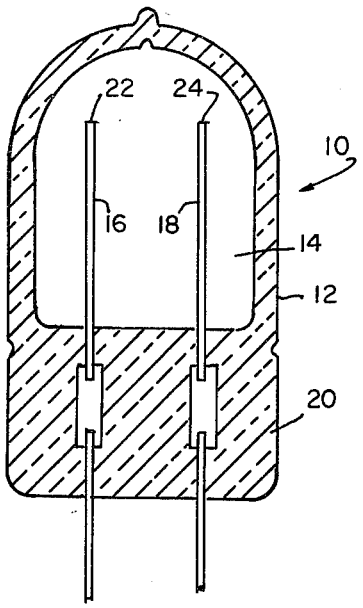
PRIOR ART FIG. 1
FIG. 1 is a sectional view of one form of a known single end high intensity discharge device.

Referring now to the drawings with greater particularity, there is shown in FIG. 1 a prior art high intensity discharge device 10 comprising a body 12 of, for example, quartz, containing an arc chamber 14 having therein an arc generating and sustaining medium. Electrodes 16 and 18 are sealed in body 12 as by a press 20.

Electrodes 16 and 18 are substantially parallel throughout their entire length, a geometry which produces very large field gradients near the tips 22 and 24. These large field gradients tend to accentuate the cathode spot region and promote spot wandering around the tips. This condition usually forces the device user to employ the lamp in a manner that keeps the arc column in a predetermined orientation.

These problems can be alleviated and a device provided which produces an extremely stable arc operable in any position by employing the teachings of this invention.

Figure 2:
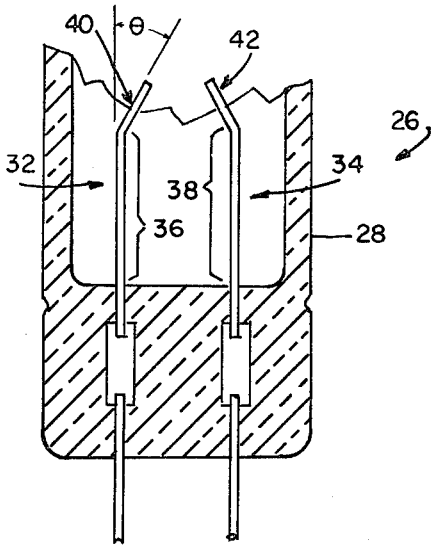
FIG. 2 is a sectional view of an embodiment of the invention.

Referring specifically to FIG. 2 a high intensity discharge device 26 comprises body 28 and arc chamber 30 containing the requisite fill. Electrodes 32 and 34 are conventionally sealed therein. The electrodes 32 and 34 have major portions 36 and 38 which are substantially parallel to each other and minor portions 40 and 42 which converge toward each other.

The departure from the vertical of minor portions 40 and 42 is indicated as being an angle $\ominus$ which can be from 20° to 90° with 45° being preferred.

While the exact reason for the increased stability of the arc produced by electrodes 32 and 34 is not known it is believed to be related to the lack of a burning spot on the electrode surface.

Figure 3:
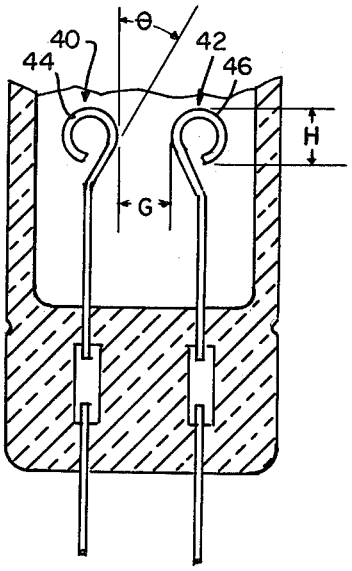
FIG. 3 is a sectional view of an alternate embodiment of the invention.

An alternate embodiment of the above concept is shown in FIG. 3 wherein the minor portions 40 and 42 are formed as loops 44 and 46 which lie in a common plane. The loops 44 and 46 define a convergent region defined by the angle $\oplus$. The loops have a height "H" and define therebetween an arc gap "G". In the preferred mode "H" and "G" should be approximately equal.

Figure 4:
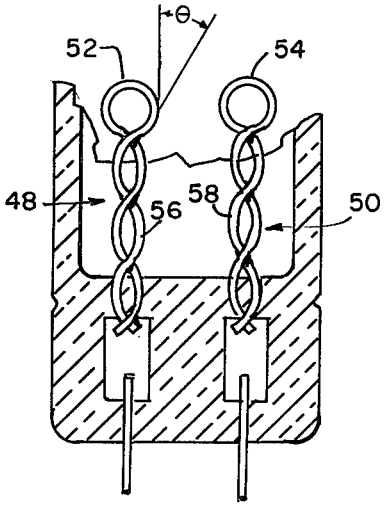
FIG. 4 is a sectional view of yet another alternate embodiment of the invention.

Yet another embodiment is shown in FIG. 4 wherein electrodes 48 and 50 are formed from twisted wire to form the loops 52 and 54 and major portions 56 and 58. While the particularities described above with respect to spacings, etc. apply to the electrodes 48 and 50, these latter electrodes have the additional advantage of providing two heat conduction paths away from the discharge attachment point.

In each of the embodiments disclosed above the arc can be driven from magnetic, 60 Hz, solid state high frequency or solid state D.C. power supplies. The stability appears to be unaffected by the mode of operation or orientation.

Preferred materials for the electrodes include tungsten, tungsten-thoria (2% Th $0_2$) and tungsten-rhenium (3% Rh) of diameters ranging from 0.010" to 0.020".

It is believed that the independence of the electrode materials with regard to arc stability results from the convergent geometry of the minor portions, particularly in the case of the loop electrodes. In the plane of the loops the electric field lines decrease continuously and symmetrically away from the gap. By contrast, the electrode geometries typified by parallel straight rods produce very large fields gradients near the electrode tips wich tend to accentuate the cathode spot region and promote spot wandering around the tip.

While there have been shown and described what are at present considered to be the preferred embodiments of the invention, it will be apparent to those skilled in the art that various changes and modifications can be made herein without departing from the scope of the invention as defined by the appended claims.

We claim:

1. A high intensity arc discharge device having a transparent body including an arc chamber containing an arc generating and sustaining medium and a pair of electrodes sealed in said body and extending into said arc chamber, said electrodes having major portions and minor portions, said major portions of said electrodes being substantially parallel with respect to each other and said minor portions being formed as substantially circular loops at least partially convergent toward each other, a stable arc region existing primarily between said convergent portions of said loops.

2. The device of claim 1 wherein said major portions of said electrodes comprise two strands of material twisted together.

3. The device of claim 2 wherein said loops converge toward each other at an angle of about 45°.

* * * * *